United States Patent [19]

Braat et al.

[11] 4,230,178

[45] Oct. 28, 1980

[54] HEAT EXCHANGER WITH PUMP

[75] Inventors: Antonius M. M. Braat, Roosendaal; Harry Lagerwerf, Rotterdam, both of Netherlands

[73] Assignee: B. V. Neratoom, Netherlands

[21] Appl. No.: 39,363

[22] Filed: May 16, 1979

[30] Foreign Application Priority Data

May 19, 1978 [NL] Netherlands ..... 7805467

[51] Int. Cl.[3] ..... F28D 7/12; F28F 13/12

[52] U.S. Cl. ..... 165/76; 165/107 R; 165/120; 165/142

[58] Field of Search ..... 165/109, 107, 142, 120, 165/160, 76

[56] References Cited

U.S. PATENT DOCUMENTS

| | | | |
|---|---|---|---|
| 2,085,924 | 7/1937 | Riegler | 165/109 |
| 2,557,622 | 6/1951 | Trier | 165/109 |
| 2,665,556 | 1/1954 | Otten | 165/142 |
| 3,242,981 | 3/1966 | Hutchinson et al. | 165/142 |
| 3,373,802 | 3/1968 | Wikluno et al. | 165/109 |
| 3,651,866 | 3/1972 | Lileg et al. | 165/107 |
| 4,038,134 | 7/1977 | Dorner et al. | 165/107 |

*Primary Examiner*—Sheldon Richter

[57] ABSTRACT

A heat exchanger comprising a casing wherein a bank of tubes is arranged and provided with means for conducting a first medium through the tubes of the bank from a supply opening for said medium in the wall of the casing, and means for conducting a second medium from another supply opening in the wall of the casing around the tubes of the bank towards a discharge opening in the wall of the casing, whereby the means for conducting the second medium through the apparatus comprise a pump impeller arranged centrally at the bottom of the casing, said impeller being connected to a pump shaft projecting upwardly within a cylindrical inner jacket disposed centrally in the casing and which is driven above the casing by a motor arranged in situ, while the tube bank for the first medium is an annular bank which is arranged around the cylindrical jacket, whereby the tubes of the bank are tubes of the bayonet type.

5 Claims, 2 Drawing Figures

HEAT EXCHANGER WITH PUMP

Figure 1:
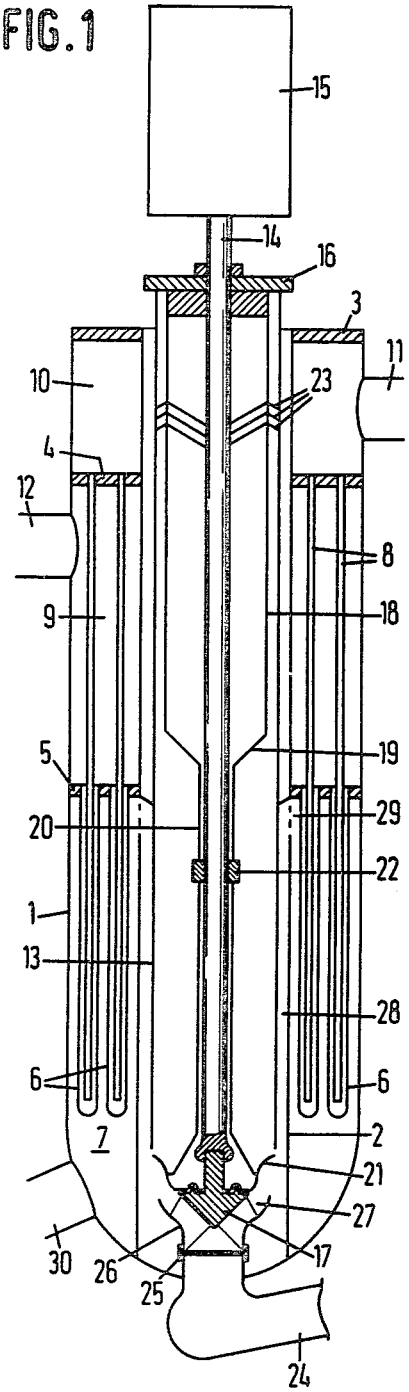

The present invention relates to a heat exchanger comprising a casing with arranged therein a tube assembly and provided with means for conducting a first medium through the tubes of the assembly from a supply opening for the first medium in the wall of the casing to a discharge opening for the first medium in the wall of the casing, as well as means for conducting a second medium from a supply opening in the wall of the casing around the tubes of the assembly to a discharge opening in the wall of the casing.

Such a heat exchanger is known e.g. from Dutch Pat. No. 138,746. In particular this patent describes a heat exchanger wherein the first medium is a gaseous cooling medium for a nuclear reactor and the second medium conducted through the tubes of the assembly a heat-absorbing medium, e.g. water. The construction of the prior art apparatus is very compact. The drawback of the apparatus according to this patent, however, seems to be that the components are not simply exchangeable. In case of a leak in one of the tubes of the assembly, repair does not seem possible until after disassembly of practically the entire heat exchanger.

It is the object of the invention to provide a heat exchanger that like the prior art heat exchanger has a compact construction, but whose components are exchangeable more easily than in the prior art apparatus. Especially it is the object of the invention to provide a heat exchanger that may serve as intermediate heat exchanger for dispensing heat of liquid sodium of the primary system of a liquid sodium-cooled nuclear reactor, to liquid sodium of the secondary system of said reactor.

The object is achieved with a heat exchanger wherein the means for conducting the second medium through the apparatus comprise a pump impeller arranged centrally at the bottom of the casing, which is connected to a pump shaft which extends upwardly within a cylindrical inner jacket arranged inside the casing and which is driven above the casing by a motor disposed in situ, and that the tube assembly for the first medium is an annular assembly which is arranged around the cylindrical jacket, the tubes of the assembly consisting of bayonet type tubes.

Preferably the annular tube assembly comprises a plurality of tubes attached with their top end in or to a first annular tube sheet, which tubes are closed at their lower end, as well as a corresponding number of tubes attached with their top end in or to a second annular tube sheet, said tubes having smaller outer diameters than the inner diameters of the tubes closed at the bottom, which thinner tubes are open at their lower end and which thinner tubes each project in one of the tubes closed at the bottom, in such a way that between first and second tube sheet there is provided a space adjacent of which the discharge opening for the first medium is disposed in the wall of the casing, while above the second tube sheet there is present a space adjacent which the supply opening for the first medium is disposed in the wall of the casing.

The heat exchanger according to the invention has the advantage that, if necessary, the annular tube assembly may be lifted from the casing without requiring disassembly of other parts of the heat exchanger. It is also possible, if desired, to remove the pump impeller from the casing without the necessity to remove the tube bank for the secondary cooling fluid. This makes it possible to rapidly carry out periodical inspections, while replacements of parts subjected to wear can be conveniently effected. Since the pump is integrated in the heat exchanger, it is present in the hot branch of the cooling system, so that a minimal pressure loss between reactor and cooling system is realized. Since the pump furthermore comprises a pump impeller arranged centrally at the bottom of the casing of the heat exchanger and the bearing of the pump shaft may likewise be present at a low level, it is ensured that the pump continues to operate even in case of emergencies, whereby the sodium in the system may descend to the so-called emergency level. The pump impeller is present underneath said emergency level. The pump may be suitably designed as pump of the so-called free-surface type, whereby the gas space is in direct communication with the reactor vessel.

It is observed that in the earlier mentioned Dutch Pat. No. 138,746 there is described an embodiment of the above-described heat exchanger, wherein a complete pump is arranged at the bottom of the casing (see FIG. 2 of the patent). The particular, easily withdrawable construction according to the invention, however, is not taught by said publication.

In a preferred embodiment of the heat exchanger according to the invention, the thinner tubes of the tube bank or assembly are of the bayonet type, each of a double-walled design, an insulating gas being retained in the space between the walls. A suitable embodiment, furthermore, is characterized in that the first tube sheet shuts off a space between the wall of the casing and a cylindrical jacket at the top arranged concentrically therein, which cylinder jacket is secured to the underside at the bottom of the casing and extends upwardly beyond the first tube sheet as far as or to adjacent the top end of the casing, so that the cylinder jacket bounds the space between first and second tube sheet at the side of the centre line of the casing, while the cylinder jacket adjacent the first tube sheet, but therebelow is provided with openings through which second medium forced upwardly by the pump inside the cylinder jacket may reach the space between the wall of the casing and the cylinder jacket underneath the first tube sheet.

The bank of tubes of the heat exchanger according to the invention is entirely withdrawable. Through application of so-called bayonet tubes, the inner tubes may be designed individually withdrawable, which facilitates rapid inspections. Also repair of defective tubes is convenient in the heat exchanger according to the invention and rapidly feasible.

It is observed that tubes of the bayonet type are already known per se, e.g. from Dutch application No. 7112562.

In the heat exchanger according to the invention furthermore there may be utilized in a suitable manner a supercritical pump shaft, possibly provided with a damper, enabling to keep the diameter of the pump shaft and of the pump impeller relatively small, so that a comparatively small central tube may be sufficient, thus increasing the compactness of the apparatus. The pump impeller is for instance a semiaxial impeller, e.g. of the type which is described in French patent application No. 7,529,573 (publication No. 2,326,011).

By combining according to the invention pump, heat exchanger and possibly valve in one vessel, there is obtained a compact primary system by means of which a substantial saving of cost for buildings and components can be achieved.

Figure 2:
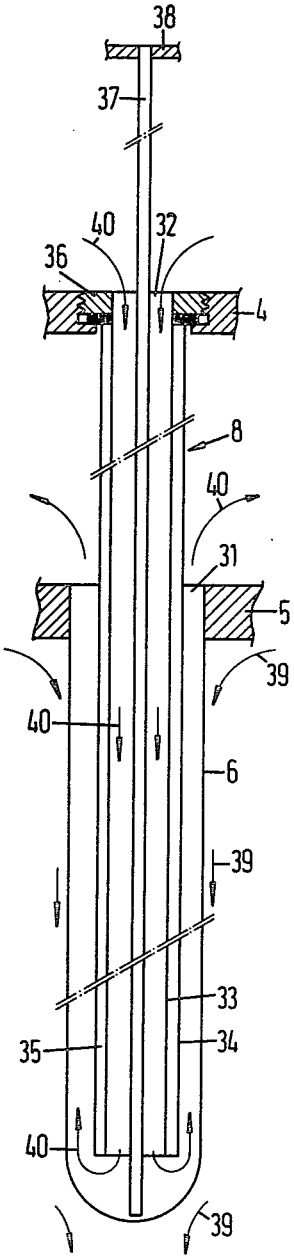

The invention will now be explained, by way of example, with reference to the accompanying drawing, wherein:

FIG. 1 shows a cross-section of an embodiment of the heat exchanger according to the invention, and FIG. 2 shows a cross-section of an embodiment of the bayonet tube which may be employed in the heat exchanger according to the invention.

The embodiment shown in FIG. 1 of the heat exchanger according to the invention comprises a casing or vessel 1 of e.g. cylindrical shape having a hollow dish-shaped lower end. Inside of vessel 1 there is arranged an inner jacket 2. The inner jacket 2 has likewise a cylindrical shape and is concentric with the vessel 1. The diameters of the inner jacket 2 and of the vessel 1 are such that between jacket 2 and vessel 1 there is produced an annular space accommodating the tube assembly of the apparatus. At the topside the space between vessel 1 and inner jacket 2 is shut off by a detachable cover 3 which has an annular shape. The tube assembly arranged in the space between the vessel 1 and the inner jacket 2 and which, after removal of the cover 3, may be withdrawn, if desired, entirely from said space, consists of a first tube sheet 4 and a second tube sheet 5. Those tube sheets are of annular shape.

The tubes 6 are attached in or to the tube sheet 5. The tubes 6 extend from the tube sheet 5 downwardly into space 7 which is bounded by the vessel 1, the inner jacket 2 and the tube sheet 5. The tubes 6, as shown, are closed at the under-side, so that any medium in the tubes 6 can leave the tube solely via the opening in the tube sheet 5 to which the respective tube 6 connects. The tubes 8 are attached in or to the tube sheet 4. The tubes 8 extend from the tube sheet 4 downwardly into the space 9 which is bounded by the tube sheets 4 and 5 and by the vessel 1 and the inner jacket 2. The tubes 8 have such a length that they, furthermore, project through the openings in the tube sheet 5 into the respective tubes 6 underneath the tube sheet 5 extending to approximately a slight distance from the closed lower end of the tubes 6. The tubes 8 themselves are open at their lower end. The open top end of each tube 8 connects to openings in the tube sheet 4 or each tube 8 projects with the open top end in openings in the tube sheet 4, according to the manner of attachment of the tubes 8 in or to the tube sheet 4. Above the tube sheet 4 there is present the collecting chamber 10.

In the wall of the vessel 1 there is disposed an opening to which a supply conduit 11 is connected. The supply conduit 11 terminates in the collecting chamber 10 and via the supply conduit 11, in operation, secondary cooling medium is introduced in the heat exchanger. This medium is subsequently conducted from the collecting chamber 10 through the tubes 8, arriving in the tubes 6 and conducted therefrom upwardly to the space 9. In the wall of the vessel 1 there is disposed adjacent the space 9 an opening to which a discharge conduit 12 is connected. Via conduit 12, in operation, the secondary cooling medium supplied in the space 9 from the tubes 6 is discharged.

In the vessel 1, within the inner jacket 2, there is arranged a cylindrical tube 13 which is concentric with the vessel 1 and the inner jacket 2. The tube 13 has a smaller diameter than the inner diameter of the jacket 2, so that a space is produced between the tube 13 and the jacket 2. The tube 13 projects through the opening in the cover 3 slightly above the vessel 1 and projects to the bottom of the vessel 1 to some distance from the bottom. The tube 13 is suitably mounted in the vessel 1. In the tube 13 there is arranged the pump shaft of the pump for the apparatus. Pump shaft and pump impeller are so constructed that they can be entirely withdrawn from the tube 13 and be taken from the apparatus. The pump construction is for instance the following:

The pump shaft 14, driven by the motor 15, is conducted through the cover 16 in the tube 13 and extends concentrically in the tube 13. At the bottom of the pump shaft 14 there is mounted the pump impeller 17. The pump impeller 17 is disposed below the bottom end of the tube 13 and for instance is of the semi-axial type, as described in French publication No. 2,326,011. Around the pump shaft 14 there is disposed the concentric tube 18, having a diameter that is slightly smaller than that of the tube 13, so that between the tube 13 and the tube 18 there is provided an annuler space. The tube 18 extends from the cover 16 downwardly and inside the tube 13 merges via a frustoconical jacket portion 19 into tube 20 having an inner diameter that is only slightly larger thant the diameter of the pump shaft 14. At the bottom of the tube 20, adjacent the pump impeller 17, there is mounted a suitable bearing construction 21. The outer wall of said construction likewise constitutes the wall of annular fluid channel 27 through which the primary cooling fluid advanced by the pump impeller is pumped upwardly in operation.

To the tube 20 may be secured a damper 22 around the pump shaft 14. On the tube 18 there are, moreover, secured at the top of the tube 13 a plurality of heat shields 23 which in operation serve for reducing heat from the interior of the apparatus.

At the bottom of the vessel 1 there is provided an opening to which the supply conduit 24 for hot primary cooling medium is connected inside the vessel 1, adjacent the bottom of which the supply conduit 24 is coupled by means of a suitable ring member 25 to the dish-shaped funnel tube 26 which is arranged spaced apart from the pump impeller 17. The inner wall of the funnel tube 26 constitutes the outer wall of the annular fluid channel 27, the inwardly disposed wall of which being formed by the pump impeller 17 and the bearing construction 21. In operation the primary medium is drawn in by the pump impeller from the supply conduit 24 and pumped upwardly via the annular channel 27 in the annular space 28 between the inner jacket 2 and the tube 13. Via openings 29 in the casing 2 the primary medium is subsequently conducted in the space 7 which is bounded by the tube sheet 5, the inner jacket 2 and the vessel 1. In the space 7 the medium flows around tubes 6 downwardly and subsequently is discharged from the space 7 via a discharge conduit 30 which connects to an opening in the wall of the vessel 1 adjacent the lower end thereof.

In operation hot primary medium is supplied through the supply conduit 24 and pumped in the above-described manner to the space 7 around the tubes 6, where the medium can transmit its heat to the secondary medium which is transported through the tubes 6. The secondary medium supplied via the supply conduit 11 is thus heated in the apparatus and the heated secondary medium is discharged via the discharge conduit 12, while the primary medium, dispensing a part of its heat, is discharged via the conduit 30.

The construction of the apparatus according to the invention is very compact, while it will be clear that the pump is so constructed that it can be entirely lifted from the apparatus in a simple manner. Also the tube assembly of the apparatus is so designed that it can be entirely withdrawn in a comparatively simple manner. If desired, also the seperate tubes 8 of the assembly can be withdrawn one after the other, if it should be required, for instance for inspection purposes.

A suitable embodiment of the bayonet tube which may be utilized in the heat exchanger according to the invention is shown in FIG. 2. Parts that conrrespond to components already represented and discussed in FIG. 1, have been provided with the same reference numeral.

FIG. 2 shows a part of the tube sheet 5. Underneath an opening 31 in the tube sheet 5, tube 6 is attached to the tube sheet 5. The tube 6 may be attached to the tube sheet 5 in any suitable manner known to the expert. The tube 6 is closed at the lower end. Spaced apart from the tube sheet 5 there is present thereabove the tube sheet 4, a part of which is shown. In the tube sheet 4 there is disposed an opening 32 arranged just above the opening 31 in the tube sheet 5. The tube 8 is attached in the opening 32, which tube projects downwardly in the space between the tube sheets 4 and 5, and via the opening 31 in the tube 6 to some distance from the closed lower end thereof.

The tube 8 comprises a double-walled construction. The inner wall of the tube 8 is formed by a tube 33 and the outer wall by a tube 34. The tubes 33 and 34 are concentric and have such different diameters that there is produced a space 35 therebetween. At their lower ends the tubes 33 and 34 are suitably attached to each other, so that the space 35 is shut off at the bottom side. At the top side the tubes 33 and 34 are suitably secured to a locking screw 36 of annular form, so that the space 35 is shut off also at the top. The space 35 may be suitably filled with an insulating gas, so that no or practically no heat transfer takes place of the medium which is present in the tube 6 around the tube 8 and which is present in the space between the tube sheets 4 and 5 around the tube 8 and the medium supplied by the tube 8.

The annular locking screw 36 is threaded at the outer circumference and is screwed thereby in the opening 32 threaded along the inner circumference. This construction enables the tube 8, if necessary, to be rapidly and conveniently removed from the tube sheet 4 for inspection pusposes, and if necessary, be replaced by another tube 8. The annular locking screw has also a sealing function between space 10 and 9.

Along the centre line of tubes 8 and 6, as shown, there may be disposed a draining tube 37 for emptying the tube 6 in case of disengagement of the apparatus. The draining tube 37, which projects to adjacent the bottom of the tube 6, may be secured to the top side in a tube sheet 38 which is spaced apart above the tube sheet 4. The tube sheet 38 may, for instance, be disposed underneath the cover 3 (FIG. 1) or, if desired, form part thereof.

In operation primary, hot medium is supplied in the space underneath the tube sheet 5 and conducted downwardly around the tube 6 therealong, as indicated by the arrows 39 in FIG. 2. Secondary medium, which has to absorb heat from the hot primary medium, is conducted from the space above the sheet 4 through the tube 8 to the bottom of tube 6, from where the medium is conducted upwardly through the tube 6 into the space between the tube sheets 4 and 5, as indicated in FIG. 2 by the arrows 40. Via the wall of the tube 6 heat of the primary medium may be transmitted to the secondary medium.

We claim:

1. A heat exchanger, comprising a casing, a cylindrical inner jacket arranged centrally in said casing, an assembly of tubes of the bayonet type arranged as an annular bank around the cylindrical jacket in said casing, a supply opening for a first medium in the wall of said casing, a discharge opening for said first medium in the wall of said casing, means for conducting the first medium through said tubes from said supply opening to said discharge opening, a supply opening for a second medium in the wall of the casing, a discharge opening for said second medium in the wall of the casing, a pump impeller arranged centrally at the bottom of said casing for conducting said second medium from said supply opening thereof around said tubes to said discharge opening thereof, a pump shaft connected to said impeller and projecting upwardly inside said cylindrical inner jacket, and a motor disposed in situ for driving said pump shaft above said casing.

2. A heat exchanger according to claim 1, wherein said tube assembly comprises a first plurality of tubes having their lower ends closed and a second plurality of a corresponding number of tubes of smaller outer diameter than the inner diameter of the first plurality of tubes having their lower ends open, a first annular tube sheet, said first plurality of tubes being attached at their top ends to said first tube sheet, a second annular tube sheet, said second plurality of tubes being attached at their top ends to said second tube sheet, and said second plurality of tubes each projecting into one of said first plurality of tubes in such a manner that between said first and second tube sheets there is provided a first space and above said second tube sheet there is provided a second space, said discharge opening for said first medium being disposed adjacent said first space and said supply opening for said first medium being disposed adjacent said second space.

3. A heat exchanger according to claim 2, wherein said second plurality of tubes are each of a double-wall design, and an insulating gas is retained in the space between the walls.

4. A heat exchanger according to claim 2 or 3, wherein a third space is provided between said first tube sheet, the wall of the casing and said cylindrical jacket, said cylindrical jacket also bounding said first space, and openings are provided in said cylindrical jacket adjacent said first tube sheet, but therebelow, through which said second medium forced upwardly by said pump impeller inside said cylindrical jacket may reach said third space underneath said first tube sheet.

5. A heat exchanger according to any one of claims 1 to 3, wherein a supercritical pump shaft is employed.

* * * * *